United States Patent [19]

Folger

[11] Patent Number: 4,569,525

[45] Date of Patent: Feb. 11, 1986

[54] GOLF CLUB SWING TRAINING DEVICE

[76] Inventor: James D. Folger, 10252 Lesterford Ave., Downey, Calif. 90241

[21] Appl. No.: 544,566

[22] Filed: Oct. 24, 1983

[51] Int. Cl.[4] ..... A63B 69/36

[52] U.S. Cl. ..... 273/186 A; 273/186 C; 273/81 B

[58] Field of Search ..... 273/81 C, 81 D, 81 B, 273/80 B, 183 D, 186 A, 186 R

[56] References Cited

U.S. PATENT DOCUMENTS 3,414,267 12/1968 Engle et al. ..... 273/186 R
3,549,300 12/1970 Pelz ..... 273/183 D X
4,103,896 8/1978 Lorang ..... 273/183 D

FOREIGN PATENT DOCUMENTS 30050 of 1912 United Kingdom ..... 273/80 B

*Primary Examiner*—George J. Marlo
*Attorney, Agent, or Firm*—Kenneth T. Theodore

[57] ABSTRACT

The Golfer's Teaching Aid is a simulated golf club which teaches and provides the user with instant visual indication of proper and improper positions of the club throughout the swing, from address, backswing, downswing and follow-through. An error in any club position is easily visually ascertained and corrected. The Aid utilizes a square shaft and a pyramidal shaped indicator above the club's grip and which are in axial alignment with each other such that the sides of each are in complimentary alignment with each other. The sides are orientated such that when the user is addressing a golf ball, the user sees only one side of the shaft and one side of the indicator if and only if the Aid is in the correct position and attitude. Additionally, the indicator will point toward the user's middle torso if the Aid is again in the correct position. Any deviation from the above is an instant visual indication to the user of a flaw in the stance, grip and/or arm position. The indicator is also within the user's peripheral vision when the club is at the top of the backswing and follow through. This allows the user to visually know if the club is at the correct position, attitude and rotation. Highly visible and contrasting colors on the sides of the shaft and indicator visually aid the user in determining proper and improper club position. An alignment pointer on the club face extends perpendicularly outward therefrom, indicating the golf ball line-of-flight. A correctly positioned pointer allows the user to experience and learn proper arm, feet, and hand positions.

4 Claims, 5 Drawing Figures

GOLF CLUB SWING TRAINING DEVICE

DESCRIPTION OF THE PRIOR ART

1. Field of the Invention

This invention lies within the field of sporting equipment, particularly the sport of golf and teaching means used within the sport.

2. Background of the Prior Art

To those knowledgeable in the art, golf aids, attachments and numerous miscellaneous devices proliferate on the market place, all guaranteed to lower one's score. However, research of the prior art has not revealed a single device which is even remotely similar to the subject invention.

SUMMARY AND OBJECTS OF THE INVENTION

The invention is a modified gold club, whether it be a 'wood, iron and/or putter' and which provides the user with instant, visual indication of the correct and incorrect positions during its' use. The invention utilizes a square shaft with flat sides, a club head alignment pointer projecting outwardly from the club face, and a position indicator extending axially outward from the grip end of the club shaft. Highly visible coloring of the above, including the club head itself, provide the user with instant, visible indication of the club's attitude throughout the swing.

It is an object of the invention to provide the means to easily teach the correct golf grip, positions and swinging of golf clubs during the address, backswing, downswing and follow-through of a typical golf swing.

It is a further object of the invention to accomplish the above utilizing visual aids upon the golf club itself.

It is a further object to provide a golf club wherein one's knowledge of where one end of the club is will instantly teach the position and attitude of the other end.

It is a further object of the invention to provide visual indication of correct hand position/grip, 'breaking' wrists, rolling one's hands during the backswing and positions of elbows and arms during the entire swing.

DESCRIPTION OF THE PREFERRED EMBODIMENT

While the preferred embodiment is illustrated and described below, it is to be understood that variations will be apparent to those skilled in the art without departing from the principles of the invention. Accordingly, the invention is not to be limited to the specific form described and illustrated but rather is to be limited only by a literal interpretation of the claims as amended herein.

Figure 1:
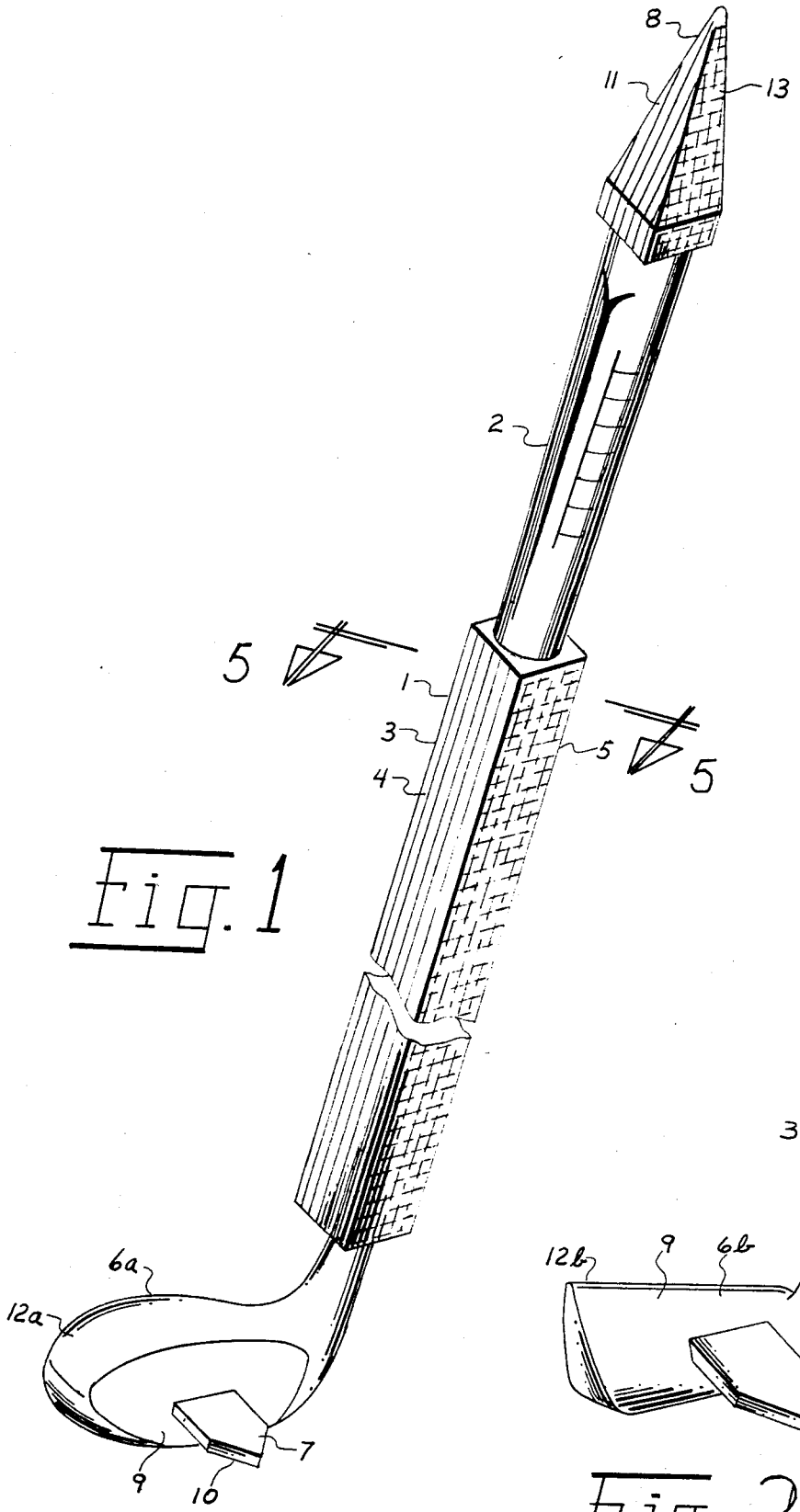
FIG. 1 illustrates the golfer's Teaching Aid as applied to a wood club.

Referring to FIG. 1, a Golfer's Teaching Aid 1, in the form of a driver or 'wood' club, is perspectively illustrated. Said Aid 1 has a handle area or hand grip 2 identical in size, shape and location to that of a regulation golf club. Regulations, as used herein, refers to those rules and regulations issued by the United States Professional Golfers Association and the United States Golfers Association, specifically those relating to the size, shape, weight and configuration of the golf clubs known as 'irons', 'woods' and 'putters'.

Extending axially outward from the lower end of said grip 2 is a square shaft 3, with on of it's sides identified as a top-side 4, such that said top-side 4 is positioned upwardly and in full view of the user's vision when addressing the golf ball. Adjacent sides 5 are perpendicular to said top-side 4 and are parallel to the user's line-of-sight at said position.

Attached to and extending outwardly beyond said shaft 3 is a regulation sized wooden clubhead **6*a* having a clubface 9. Extending perpendicularly outward from said clubface 9 and parallel to the ground is a clubhead alignment pointer 7. Said pointer 7 is rectangular in shape with a triangularly shaped end 10 as viewed by the user upon addressing the ball. Said pointer 7 is mounted upon said clubface 9** in the direction to indicate the golf ball's intended line-of-flight.

At the upper end of said grip 2 and extending axially beyond the length of a regulation club is a club position indicator 8. Said indicator 8 has an elongated pyramidal shape, such that the four lines prescribing the base of the pyramidal shape lies within the plane of said sides 4,5. This alignment of said base fixes the orientation of the sides of said indicator 8 to those of said shaft's sides 4,5 and is hereinafter referred to as planer alignment, such that said indicator 8 has an indicator surface 11 in a complimentary planer alignment with said top-side 4. The same planer alignment described above also is true of said sides 5, 13. Said indicator 8 extends approximately 7 inches beyond said grip 2.

Figure 5:
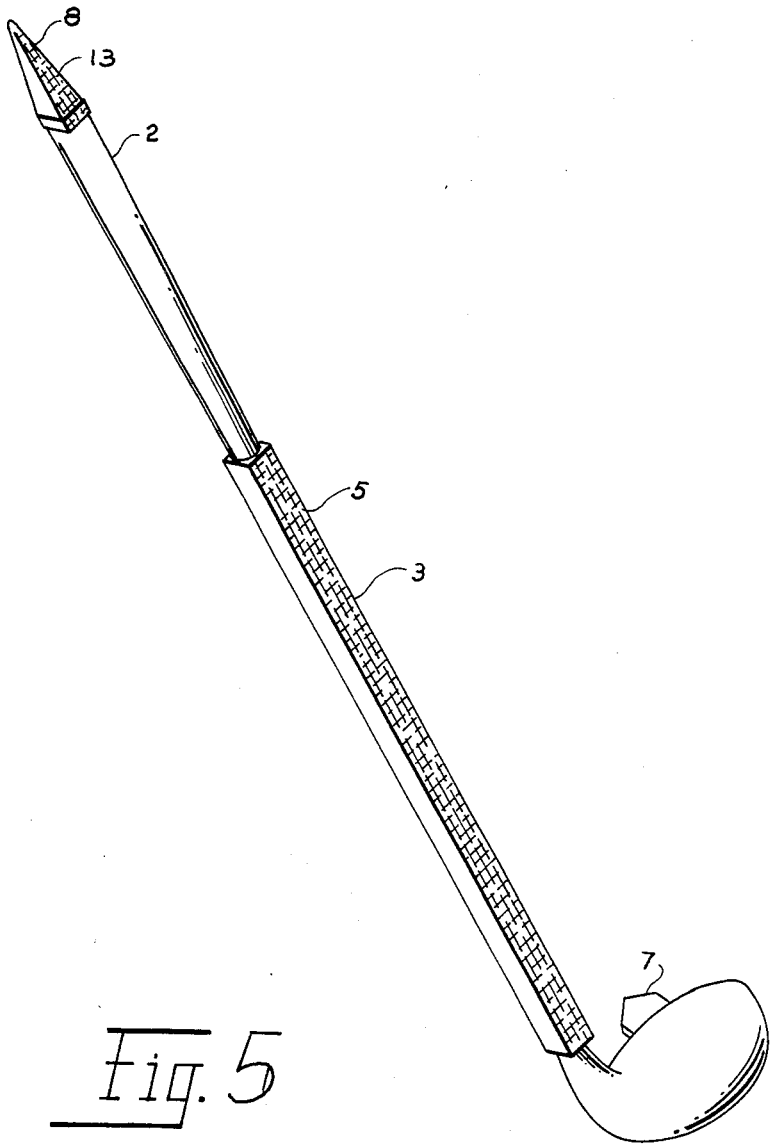
FIG. 5 is a rearview of the Aid illustrating the side and it's coloring which is not visible in FIG. 1.

Said surface 11, top-side 4 and the upper surface **12*a* of said head 6*a* are areas highly visible to the user during the golf swing and as such are critical elements of the invention. These surfaces are colored to contrast with their adjacent sides 5, 13 and said clubface 9 under two different color schemes; the first having a bright, readily visible color for said sides 5, 13 and clubface 9 with a contrasting low visibility color on said top-side 4 and surfaces 11, 12*a* as shown in FIG. 1 and FIG. 5; and the second color scheme being the opposite of the above. When using the first color scheme, the golfer addressing a ball will not see any of the Aid's 1 bright colors if he has a correct stance. If the user would see such a color, he would instantly know that Aid 1** was turned on it's axis somewhat and that there was a flaw in his stance. With the second color scheme, the golfer would see only the bright color and any reduction in its width or visibility of said contrasting color would be an indication of a turned club.

Figure 2:
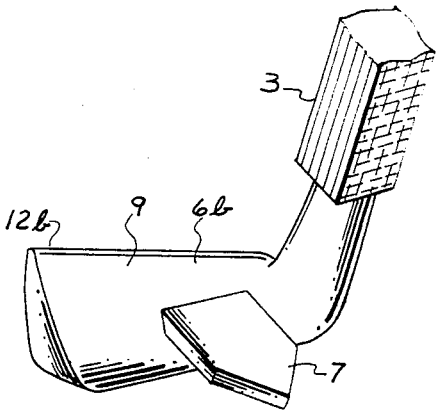
FIG. 2 illustrates the features of an iron club which differ from that of a wood club.

FIG. 2 illustrates an Aid 1 as applied to an iron club. The description above applies to the iron club except for the configuration of the iron club-head **6*b*. As illustrated, said head 6*b* has a similar colored upper surface 12*b* and clubface 9**.

Figure 3:
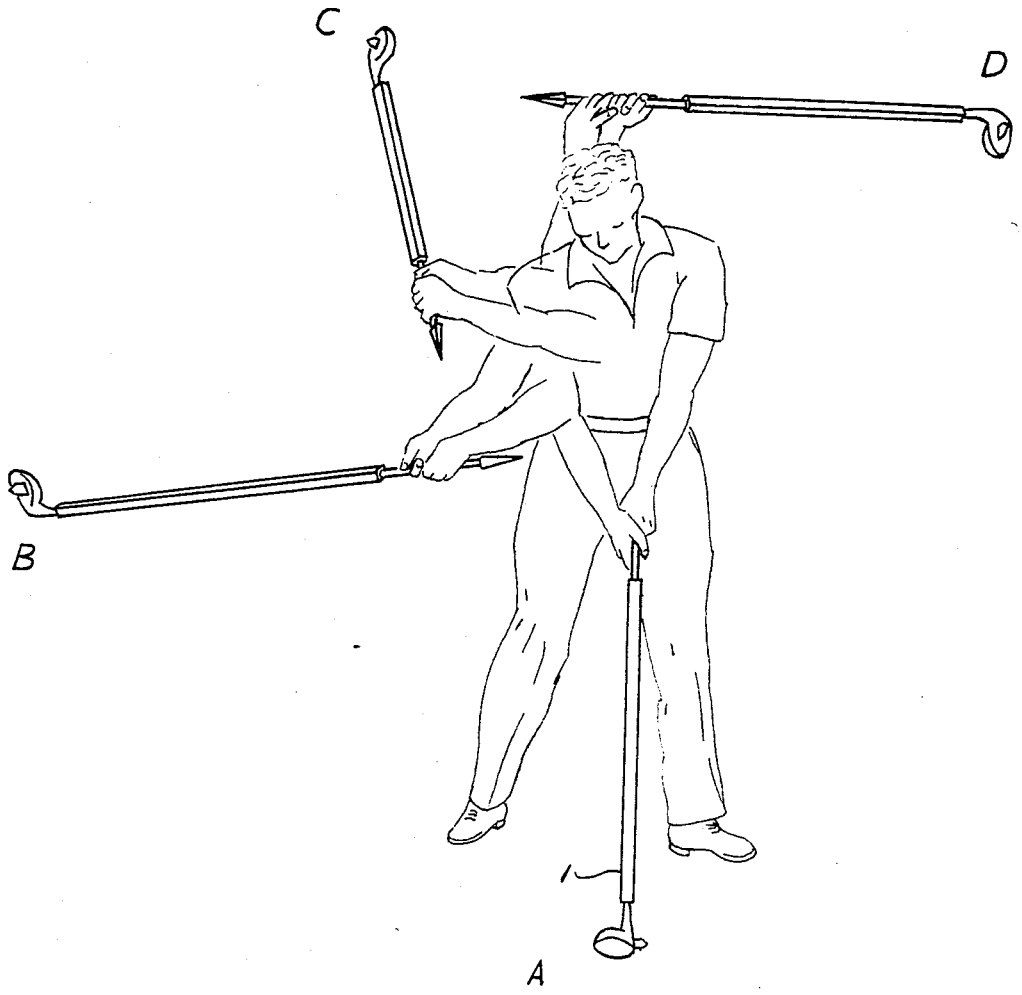
FIG. 3 is a composite illustration showing the Aid at various positions within a golf swing.

Reference to FIG. 3 illustrates the proper use and positioning of said Aid 1 by a golfer. Illustrated are the address position A, two backswing positions B and C plus the top-of-the-swing position D. To one knowledgeable in the arts, these positions are repeated on the downswing and an understanding of the Aid's 1 use for the illustrated upswing will be able to transfer that knowledge to the downswing, the hit or impact area, and the follow-through.

At position A, the perfect club position would be such that said pointer 7 would point toward the intended target and only the said top-side 4 and surfaces 11, 12*a* would be visible to the user. Also, said indicator 8 would point to the user's middle torso. Any deviation from the above would be an instant visual indication that the user is in error. For example, novices have a difficult time positioning the slightly rounded clubface 9 perpendicular to the intended line-of-flight. Said pointer, so aligned, correctly positions the clubface 9 and the user now has visual evidence of how the properly positioned clubface 9 looks like from his viewing position. Additionally, the aforementioned color schemes is additional evidence of proper club position.

With said indicator 8 correctly pointing at the middle torso, the user is assured of proper arm extension, shoulders positioned 'square', proper hand grip and foot placement.

Figure 4:
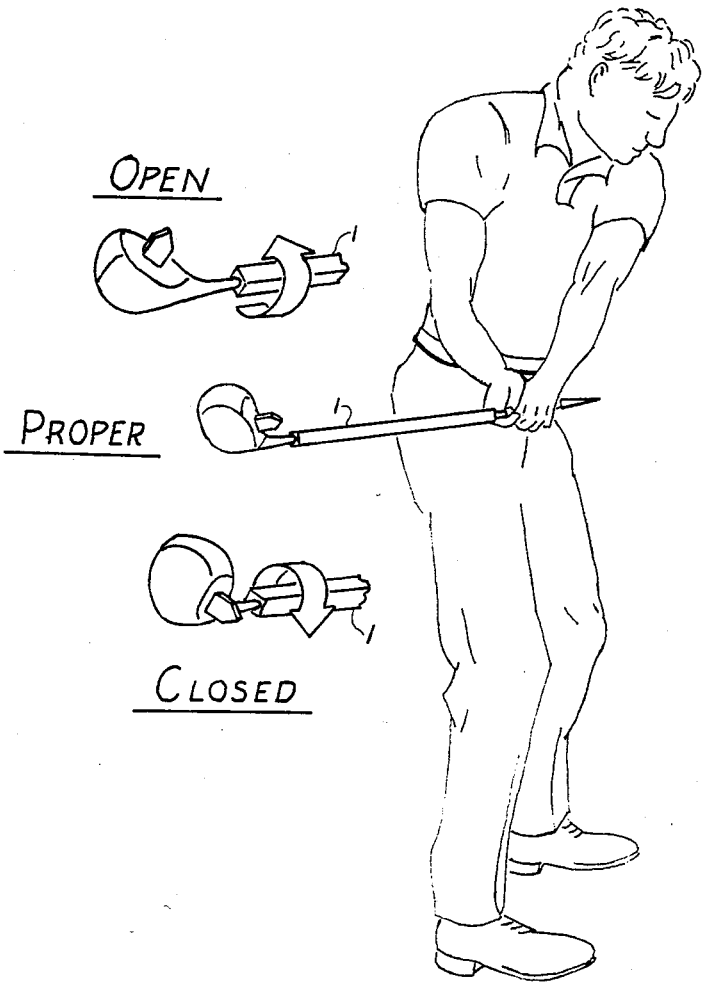
FIG. 4 illustrates the Aid on it's upswing in a correct attitude plus the incorrect 'open' and 'closed' attitudes.

At position B, said indicator 8 should be parallel to the user's left forearm and is easily visible via his peripheral vision, although turning of one's head during practice swings is perfectly acceptable. Any deviation would indicate a 'breaking of the wrists' too soon or bending of the left elbow. Said surface 11 color is to be clearly visible (or totally non-visible) and any sight of the contrasting color instantly informs the user that his wrists are rolling over. This novel feature of said invention is more clearly illustrated in FIG. 4 wherein the colors and square sides show an 'open' club via a clockwise wrist roll and a 'closed' club with the corresponding counter-clockwise wrist roll.

At position C, said indicator 8 should be pointing at the golf ball, indicating that the wrists are correctly starting to pivot. Additionally, said top-side 4 and surface 11 color should be fully visible (for the second color scheme), indicating that the wrists or hands are not rolling over.

At position D, the correct club attitude would be parallel to the ground, club shaft pointing to the intended target and the plane of said clubface 9 perpendicular to the ground. Said indicator 8 is easily visible to the user with minimum head movement and it's attitude, position and colors will provide instant verification of the club's position. As such, the user can correct for any stiff wrists, rolling over of the hands, bent left elbow, and so forth simply by his knowing the attitude of his club.

In all of the above, the user uses the Aid 1 repetitiously to acquire knowledge of the proper club position(s), his hand/shoulder/arm positions, pivoting his torso at the waist, bending of elbows, etc. This hands-on-learning is much quicker and more precise than lessons or reading golf book. And most importantly, by this repetitious use, the user acquires a 'feel' for the correct swing. Once acquired, the user no longer needs colors, indicators and the like to aid him and is then able to apply this 'feel' to regulation clubs. Additionally, all of the above references and teachings apply to putting and the club identified as the putter.

The preferred embodiment would be manufactured to simulate the length, total weight, flexibility and weight distribution of a regulation club by varying the materials and manufacturing methods as described below. However, it is desirable for teaching purposes and practice swinging that a heavier and stiffer Aid 1 be used by beginners. For these individuals, such Aids 1 will be manufactured as described below.

Additionally, a short (18–24 inches in length) version of said Aid 1 brings the club-head 6*a,b* and indicator 8 closer to the user's hands. The length reduction of said shaft 3, grip 2 and indicator 8 is typically proportional to the overall length reduction. This short version Aid 1 permits a user, within a room or enclosure, to quickly practice those fundamentals taught herein and already acquired via a 'regulation sized' Aid 1.

For those instances where a user wishes to carry the Aid 1 in the golf bag, said pointer 7 is removably secured to said clubface 9. By removing said pointer 7, said Aid 1 is easily inserted into and taken out of the bag without any additional effort than a regulation club. The attachment of said pointer 7 would be by means known by those knowledgeable in the art, such as threaded fastener means or slotted means.

The manufacture of said Aid 1 is accomplished using standard manufacturing methods. For a wood club having a relatively long, flexable shaft, it is uneconomical to match the above flexability with either wood or thin-wall metal tubing. For the preferred embodiment, molded thin wall plastic can be used as a single element comprising said shaft 3, indicator 8 and grip 2. Within the term plastic is considered those materials such as fiberglass, graphite composits and the like. The flexibility and weight distribution will be controlled by varying the wall thickness of the material and/or it's composition. The manufacturing method is also preferred for iron clubs. Said clubheads, 6*a,*6*b,* either standard or special made, are rigidly attached to the lower end of said square shaft 3 by normal attachment means. Said pointer 7, made of light weight compatable materials such as wood or plastic, is attached to said clubface 9 by normal attachment means as described above.

An alternate manufacturing method for iron clubs with stiff shafts, is to make the shaft 3, grip 2 and indiciator 8 either of wood or thin wall metal tubing. The degree of flexability is provided by varying the type of wood used (hardwoods vs softwoods) or the wall thickness of the metal tubing.

Having thus described my invention, I claim:

1. A golfer's teaching aid which simulates a regulation golf club and having a regulation shaped golf club grip with an upper and lower end thereof, a regulation sized golf club head and, a square shaped shaft having a planar topside and planar adjacent sides axially extending outwardly from the lower end of said grip, wherein said planar topside is positioned uppermost and said planar sides adjacent to and perpendicular to said topside; and a pyramidal shaped club position indicator, having planar sides attached to and extending beyond said grip upper end, to provide said golfer with visual indication of said aid's position and attitude before, during and after a golf swing, with said indicator's planar sides aligned with said square shaped shaft.

2. The aid of claim 1 wherein said head has a clubface identical to that of a regulation club, and a pointer extending perpendicularly outward from said clubface in the direction of a golf ball intended line-of-flight;

such that said pointer, properly positioned, sets the clubface in the correct attitude.

3. The aid of claim 1 wherein, the adjacent sides of said shaft and indicator are colored in a highly visible and bright color and the top surface and topside of said indicator and shaft are colored in a contrasting color, such that any viewing of said bright color by the user during the execution of a golf club swing will indicate improper club position.

4. The aid of claim 1 wherein, said topside and top surface of said shaft and indicator are colored in a highly visible and bright color, and said adjacent sides of said shaft and indicator colored in a contrasting color.

* * * * *